US008574134B2

(12) United States Patent
Greenburg

(10) Patent No.: US 8,574,134 B2
(45) Date of Patent: Nov. 5, 2013

(54) APPARATUS AND METHOD FOR TREATING THE FOOT

(76) Inventor: Stuart Greenburg, Stevenson Ranch, CA (US)

( * ) Notice: Subject to any disclaimer, the term of this patent is extended or adjusted under 35 U.S.C. 154(b) by 271 days.

(21) Appl. No.: 12/845,083

(22) Filed: Jul. 28, 2010

(65) Prior Publication Data

US 2011/0028870 A1 Feb. 3, 2011

Related U.S. Application Data

(60) Provisional application No. 61/229,433, filed on Jul. 29, 2009.

(51) Int. Cl.
*A63B 21/00* (2006.01)

(52) U.S. Cl.
USPC ..... 482/79; 482/80; 482/45; 482/44; 482/49

(58) Field of Classification Search
USPC ..... 482/79, 80, 49, 44, 45
See application file for complete search history.

(56) References Cited

U.S. PATENT DOCUMENTS 2,720,396 A * 10/1955 Pfaus ..... 482/130
4,199,137 A 4/1980 Giguere
4,337,939 A 7/1982 Hoyle et al.
4,572,505 A 2/1986 Kornhaus
4,591,149 A 5/1986 Godfrey
4,733,859 A 3/1988 Kock et al.
5,035,421 A * 7/1991 Scheller ..... 482/79
5,087,036 A 2/1992 Cooper
5,399,155 A 3/1995 Strassburg et al.
5,643,164 A 7/1997 Teff
5,819,378 A 10/1998 Doyle
5,851,166 A 12/1998 Bernardson
5,921,009 A 7/1999 Hice
6,110,078 A 8/2000 Dyer
6,217,488 B1 4/2001 Bernardson
6,283,897 B1 * 9/2001 Patton ..... 482/79
6,821,235 B1 11/2004 Johnson et al.
7,179,206 B2 2/2007 Backes et al.
7,217,228 B2 5/2007 Marquez
2008/0269027 A1 * 10/2008 Chen ..... 482/80

* cited by examiner

*Primary Examiner* — Jerome W Donnelly
(74) *Attorney, Agent, or Firm* — Fulwider Patton LLP

(57) ABSTRACT

An exercise machine for strengthening the foot and for treating plantar fasciitis includes a foot pad for receiving a patient's foot and a resistance member associated with the foot pad. As the patient pivots the foot pad on a pivot pin located near the heel section of the foot pad, a resistance is applied to the toe section of the foot pad thereby providing strengthening for the plantar fasciitis band of tissue.

19 Claims, 7 Drawing Sheets

FIG. 7
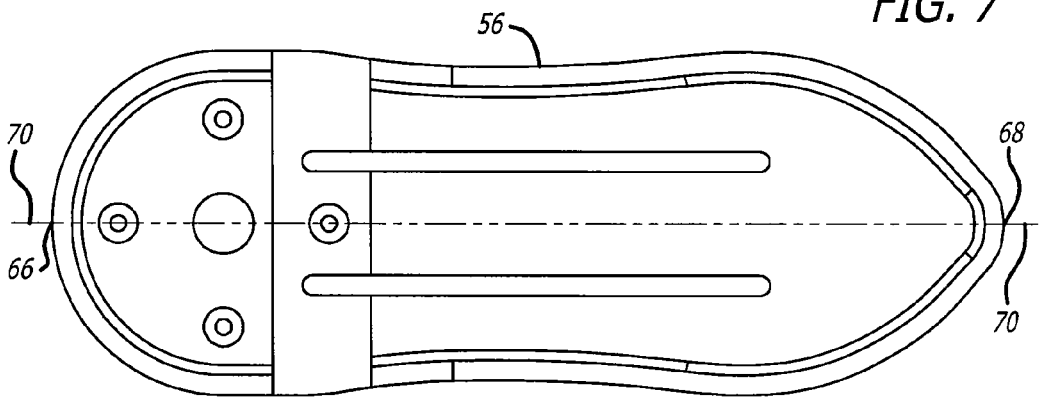
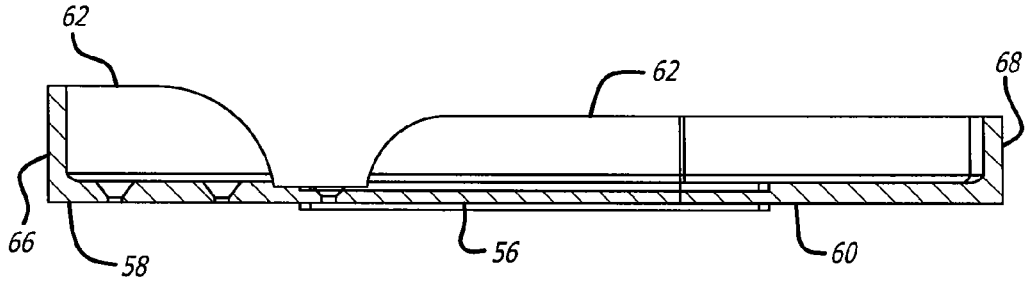
FIG. 8
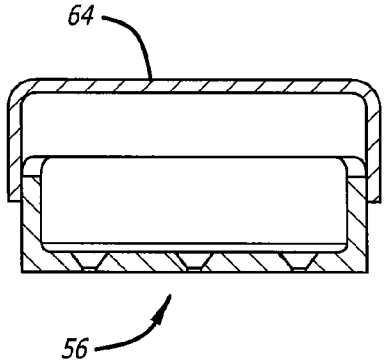
FIG. 9

APPARATUS AND METHOD FOR TREATING THE FOOT

CROSS-REFERENCES TO RELATED APPLICATIONS

This application claims priority from U.S. Application No. 61/229,433 filed Jul. 29, 2009 and is incorporated by reference in its entirety.

BACKGROUND

The invention relates generally to an apparatus and device for strengthening the foot and more particularly for rehabilitating plantar fasciitis using weights or resistance.

The present invention relates to an apparatus and method for rehabilitating a person having plantar fasciitis. Plantar fasciitis is one of the most common causes of heel pain. It involves pain and inflammation of a thick band of tissue, called the plantar fascia, which runs across the bottom of the foot, connecting the heel bone to the toes. Plantar fasciitis causes intense pain which usually occurs with the first steps in the morning. Once the foot limbers up, the pain of plantar fasciitis normally decreases, but it may return after long periods of standing or getting up from a seated position.

Plantar fasciitis is particularly common in runners. People who are overweight, women who are pregnant and those who wear shoes with inadequate support are at higher risk of plantar fasciitis and, if left untreated, it can interfere with walking and daily living activities as well as athletic activity. Non-surgical treatment of this condition involves anti-inflammatory agents as well as lengthening of the plantar fascia through a stretching routine designed to remove tension on the muscle tissue. Unfortunately, traditional active and passive stretching techniques only supply temporary relief of the pain and not a permanent relief or cure. As in most cases of injury, rest is only one part of a comprehensive plan to heal damaged muscle tissue. Today's therapies include a rigorous strengthening regimen. The present invention strengthens the plantar fascia to a point of total rehabilitation as long as the user is faithful to the exercises prescribed.

SUMMARY OF THE INVENTION

The present invention is an apparatus and method of use for helping to strengthen the foot and more particularly for treating plantar fasciitis. The device can be used in commercial gyms similar to weight strengthening machines such as bench presses, leg strengthening machines, and other devices that include the movement of weights or resistance through cams and pulleys. The present invention also contemplates the use of a lateral resistance device that can be used for smaller in-home use.

In one embodiment, a weight machine includes a stack of weights having five pound increments or less, stacked vertically and attached to a pulley system. At the other end of the pulley system is a rotating plate or platform that the patient can put his foot on and move laterally in a sideways direction against resistance of the weight stack. A foot pad on the platform is configured to receive the patient's foot and hold it firmly while the patient exercises. The heel remains firmly planted in a stationary position while the toes and the rest of the foot move laterally on an arc line (circular) from side to side against the resistance of the weights on a rotating platform. The foot movements are in both directions, right to left and left to right, with the resistance of the weight being in both directions. The rotation of the plate or platform is on a pivot pin located in the area of the heel of the foot. An adjustable pin can be used to adjust the angular motion of the rotating plate to accommodate for persons having less range of motion from side to side.

In an alternative embodiment, the weight stack is replaced by resistance bands, hydraulic arms, or similar known resistance devices for imparting resistance to the rotating plate. Importantly, the amount of resistance is adjustable and the heel remains stationary on the rotating platform while the remainder of the foot moves laterally from side to side against the opposing resistance.

In another embodiment, an apparatus is provided for treating and strengthening the foot, and preferably for treating plantar fasciitis. In this embodiment, a foot pad has a heel section and a toe section and the foot pad is pivotally mounted on the frame. There is a resistance member associated with the foot pad in order to add resistance to the foot pad as it pivots on the frame. The foot pad is mounted on a first pivot pin positioned closer to the heel section than to the toe section so that as the foot pad pivots at the heel section the toe section moves on an arc line against the resistance of the resistance member. In one embodiment, the resistance member is a coil spring that provides resistance both to the right and to the left as the toe section moves laterally along the arc line. Thus, starting from a neutral position, the foot pad pivots on pivot point located in the heel section so that the toe section moves on an arc line up to 120° of motion to the right, or 120° of motion to the left against the resistance of the coil spring. The resistance as the foot pad moves to the right, for example, remains constant through the movement from the neutral position from the right and back to the neutral position, where there is no longer resistance. The same holds true for movement to the left. The coil spring is adjustable in order to increase or decrease the amount of resistance against the movement of the toe section of the foot pad. The amount of resistance that can be adjusted ranges from about one pound up to about eighty pounds. In one embodiment, the foot pad is mounted on a second pivot pin so that the foot pad can tilt at an angle of up to 90° so that the toe section is higher than the heel section. This embodiment provides the option of permitting the patient to sit in a chair and tilt the foot pad so that the toe section is higher than the heel section and comfortably operate the device while in a seated position.

BRIEF DESCRIPTION OF THE DRAWINGS

FIG. 7 is a top view of the foot pad.

FIG. 8 is a side view of the foot pad.

FIG. 9 is an end view looking at the heel section of the foot pad.

DETAILED DESCRIPTION OF THE PREFERRED EMBODIMENTS

Figure 1:
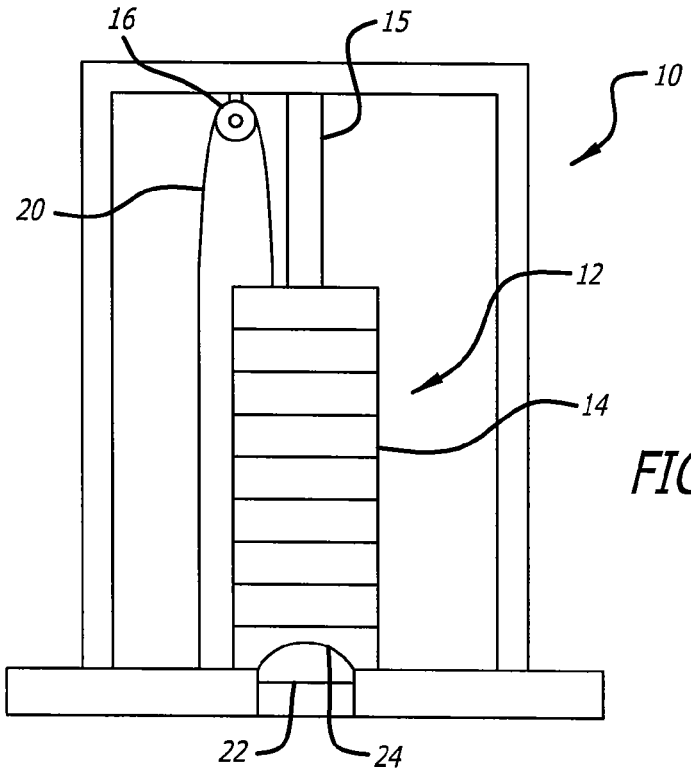
FIG. 1 depicts a front view of a weight machine having a movable weight stack to cause resistance to the rotating platform.
Figure 2:
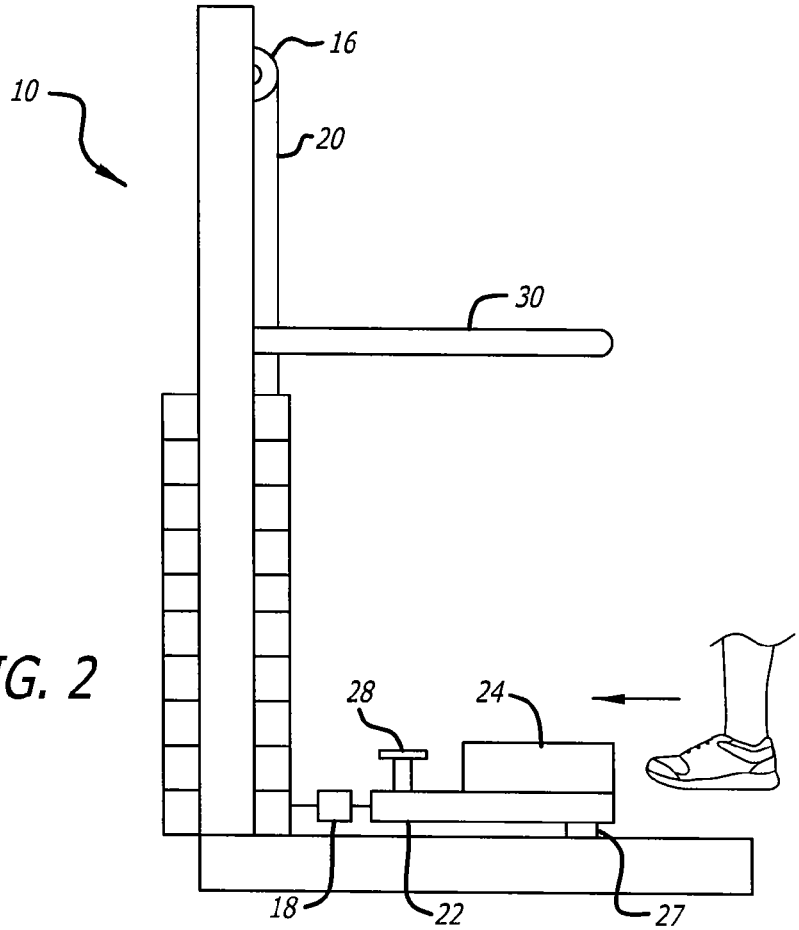
FIG. 2 is a side view of the weight machine depicting the movable weight stack and pulley arrangement attached to the rotating platform.
Figure 3:
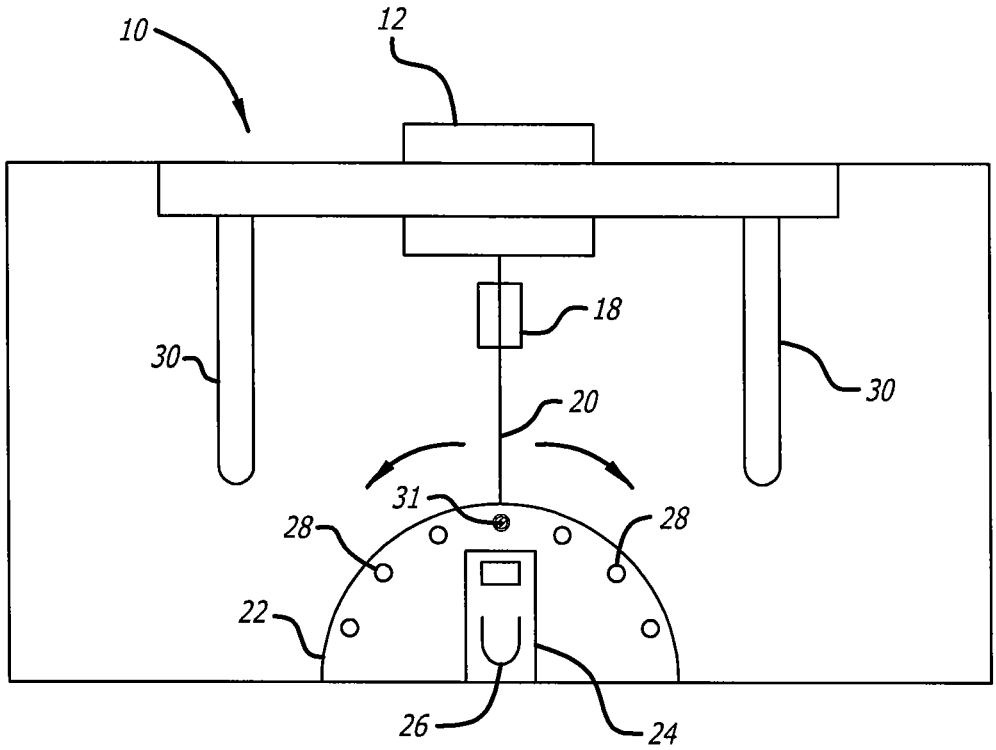
FIG. 3 is a top view depicting the weight machine including the rotatable platform having lateral movement from side to side while the heel portion remains stationary.
Figure 4:
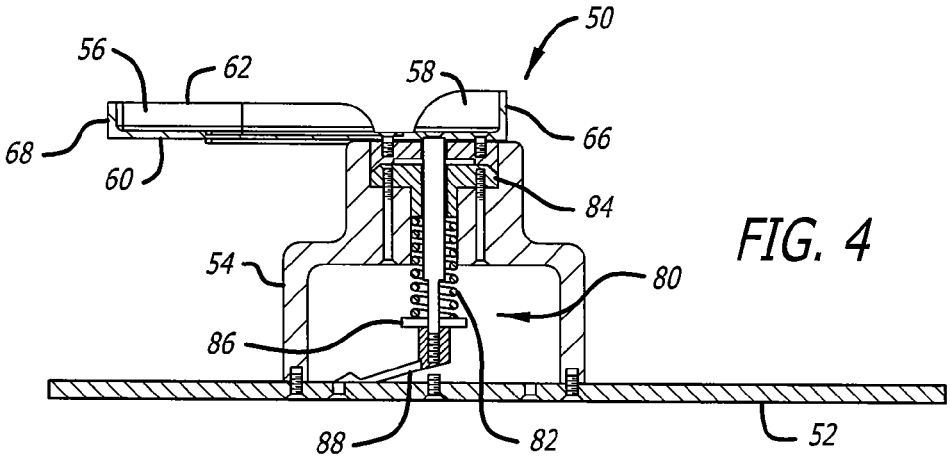
FIG. 4 is a side elevational view of the foot exercise machine.
Figure 5:
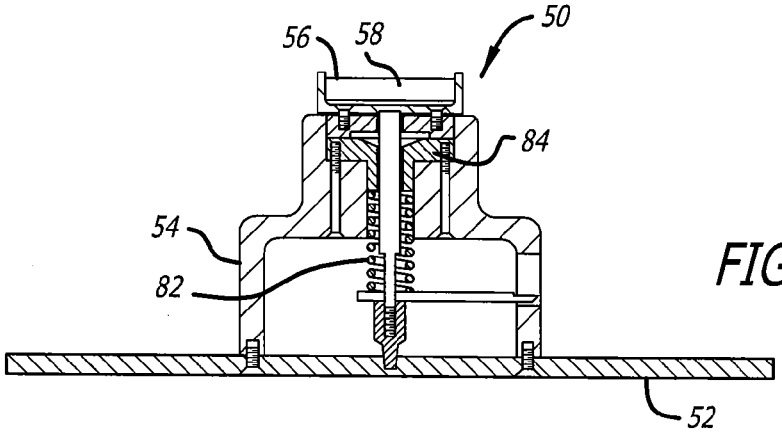
FIG. 5 is an end elevational view of the foot exercise machine.
Figure 6:
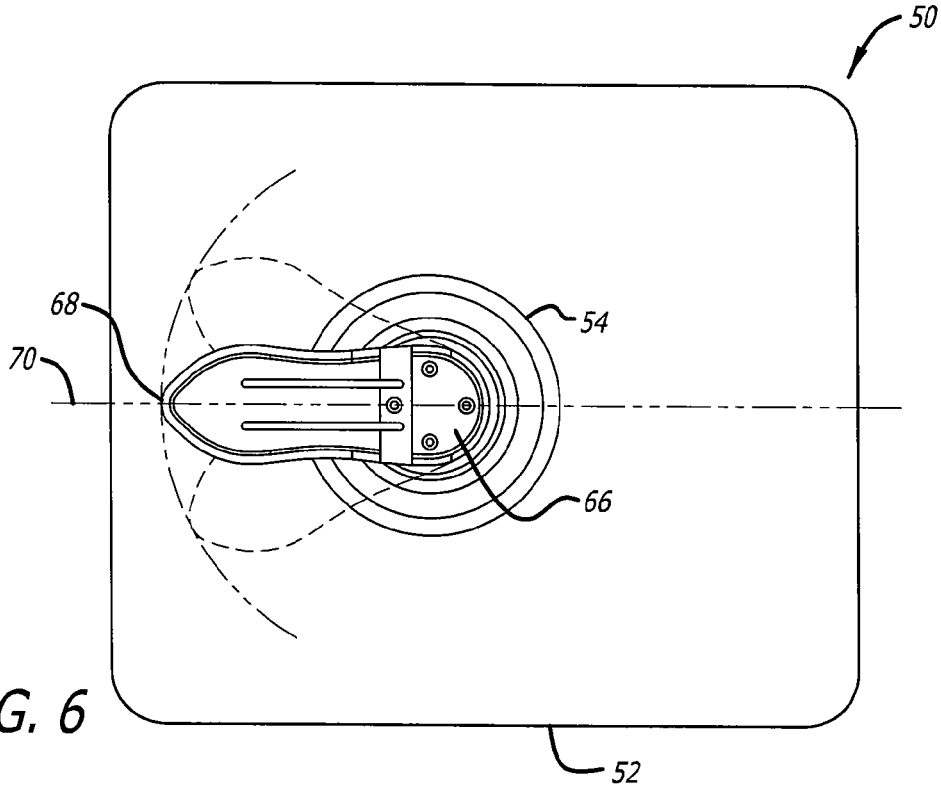
FIG. 6 is a top view of the foot exercise machine.
Figure 10:
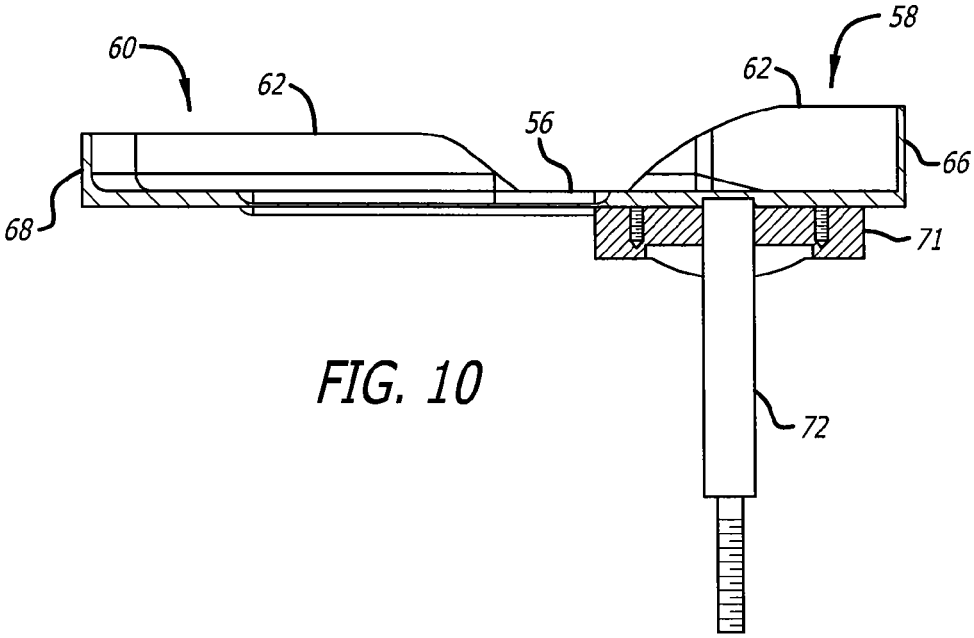
FIG. 10 is a side elevational view of the foot pad mounted on a pivot pin.
Figure 11:
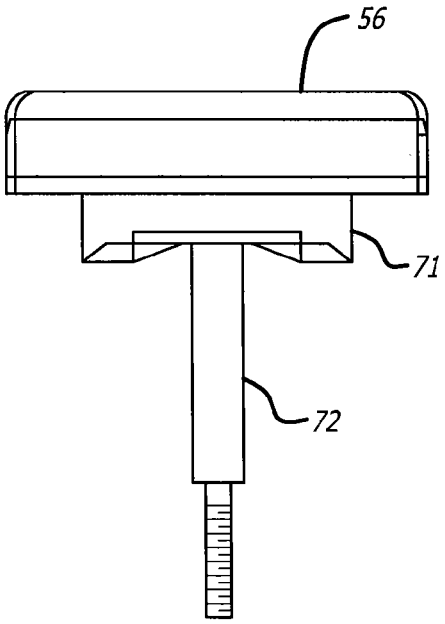
FIG. 11 is an end elevational view of the foot pad mount on the pivot pin looking at the heel section of the foot pad.
Figure 12:
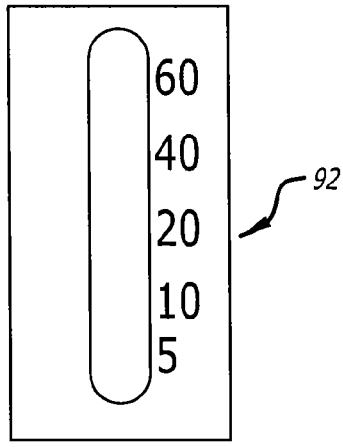
FIG. 12 is a schematic of the gauge in pounds representing the resistance applied to the foot pad.
Figure 13:
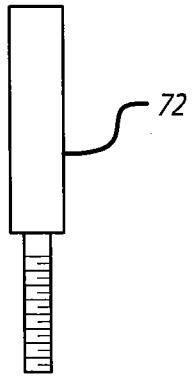
FIG. 13 is an elevational view of the pivot pin.
Figure 14:
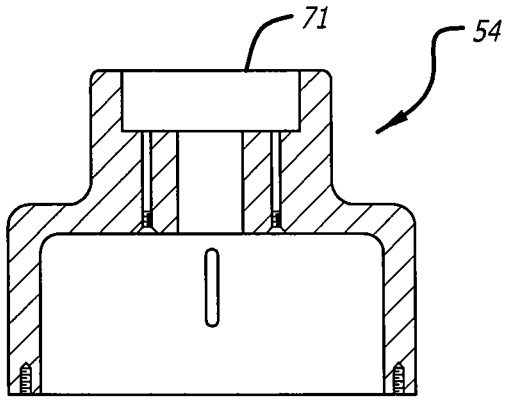
FIG. 14 is a side elevational view of the frame upon which the foot pad is mounted.
Figure 15:
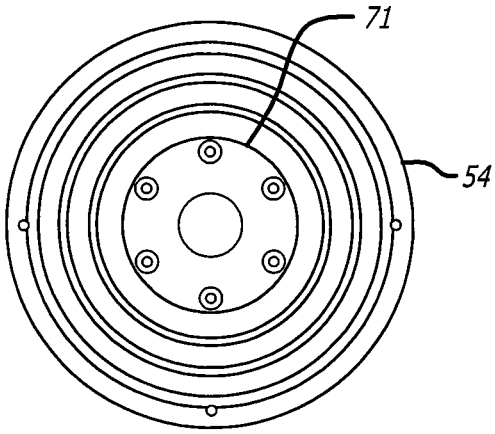
FIG. 15 is a top view of the frame upon which the foot pad is mounted.

One embodiment of the present invention is shown in FIGS. 1-3. A weight machine 10 similar to those found in commercial gyms, includes a weight stack 12 comprising movable five-pound plates 14. The plates 14 can be any incremental weight such as two pounds, four pounds, five pounds, or any combination of these increments, depending upon the total amount of weight required for a particular patient. The plates 14 are supported and can move vertically (up and down) along one or more support rods 15. A first pulley 16 and a second pulley 18 are connected together by a cable 20. A first end of the cable is attached to the weight stack and the second end of the cable is attached to rotating platform 22. Alternatively, a third pulley (not shown) can be used to change the direction of the cable from vertical to horizontal. A foot sleeve 24 is positioned on the rotating platform and is configured to receive a person's foot for use during the exercises. Preferably, the foot sleeve includes a heel support 26 which remains stationary during the exercising. In this embodiment, the rotating platform 22 is supported by and rotates on pedestal 27. The pedestal 27 is positioned beneath the heel support 26 so that the heel of the foot remains stationary as the platform 22 rotates or pivots on the pedestal 27. The pedestal 27 is anchored to a base of the machine. The rotating platform 22 includes indexed holes 28, with a pin extending through the holes, in order to adjust the amount of lateral movement of the rotating platform. A pull-pin 30 extends through the indexed holes in order to limit the amount of lateral movement of the rotating platform. Alternatively, the range of rotation or pivoting can be unlimited.

In use, a patient will place their foot through the foot sleeve 24 and rest their foot on the rotating platform 22. The patient uses the other foot for support. The patient's heel will be supported by heel support 26 which remains substantially stationary throughout the exercise. The patient selects the appropriate amount of weight on the weight stack 12 and then moves the foot in the foot sleeve in a lateral direction (FIG. 3) along an arc line that is circular against the resistance of the weight stack. Importantly, the heel of the foot remains substantially stationary in the heel support 26 while the rest of the foot moves in a lateral right to left and left to right motion, with resistance from the weight stack in both directions. The motion of the toes is substantially circular, while the foot pad and platform rotate or pivot at the heel. The pull-pin 30 can be placed in any of the indexed holes 28 in order to adjust the starting point for the rotating platform. Preferably, the patient will keep their shoes on (gym shoes or tennis shoes) during the exercise for added support. The shoes are not necessary, however, it is preferable. Support arms 30 extend from the machine 10 so the patient can hold onto the arms and maintain balance during the exercise. After the patient completes a number of repetitions with one foot, he can remove that foot from the foot sleeve 24 and insert the other foot and continue the repetitions. The device strengthens the foot in general and the plantar fascia in particular to a point of total rehabilitation as long as the user is faithful to the exercises prescribed.

In another embodiment, as shown in FIGS. 4-15, a foot exercise machine 50 includes a base 52 which typically is placed on the floor and provides support for the foot exercise machine. A frame 54 extends upwardly from the base 52 and has a foot pad 56 mounted on the top of the frame 54. The foot pad 56 includes a heel section 58 and a toe section 60 and has a flange 62 extending around the foot pad. In use, the patient places their foot on top of the foot pad 56 with the heel of the foot being in the heel section 58 and the toe of the foot being in the toe section 60. The flange 62 that extends around the foot pad helps to keep the foot positioned on the foot pad during use. A restraint 64 also can be placed on the foot pad in order to hold the foot on the foot pad during use. The restraint 64 can include a strap, sleeve or any type of securing restraint in order to hold the foot on the foot pad 56 during use. The foot pad also has a heel edge 66 and a toe edge 68 which define the longitudinal extremities of the foot pad 56 and through which longitudinal axis 70 extends. The foot pad is attached to mounting plate 71 which in turn is attached to the frame 54. A first pivot pin 72 extends through the mounting plate 71 and provides the basis for the foot pad 56 to pivot during use. It is contemplated that the foot pad 56 can be mounted with a quick release (not shown) in order to substitute different sized foot pads for different sized feet. Also, it is contemplated that the length and width of foot pad 56 be adjustable to accommodate different sized feet.

With further reference to FIGS. 4-15, the foot exercise machine also includes a resistance member 80 which can be any type of resistance member that provides a resistance to the foot pad during use. In this embodiment, a coil spring 82 is positioned in a bore in the frame and surrounds the first pivot pin 71. The coil spring 82 is restrained at its top and bottom by a top compression plate 84 and a bottom compression plate 86. The coil spring 82 is further restrained by coil spring restraint arm 88 which extends from the bottom compression plate 86 into the base 52 of the machine in order to keep the coil spring in a compressed configuration and to provide the appropriate resistance to the foot pad 56. In one embodiment, an adjustment screw 90 is provided through the base 52 of the machine in order to adjust the resistance of the coil spring 82. A resistance gauge 92 is indexed in pounds and can range from one pound up to eighty pounds in any increments determined to be appropriate for a particular patient. For example, turning the adjustment screw 90 either clockwise or counterclockwise, will increase or decrease the length of coil spring 82, thereby adjusting the amount of resistance the coil spring will apply to the foot pad 56 during use.

The location of the first pivot pin 72 with respect to the foot pad 56 is one important aspect of the invention that will determine not only how much lateral movement is applied to the toe section 60, but also the location of the application of force to the toe section. For example, in one embodiment, the first pivot pin 72 is located along longitudinal axis 70 in the heel section 58 of the foot pad 56. The first pivot pin 72 is located anywhere along the longitudinal axis extending from heel edge 66 up to about four inches along the longitudinal axis 70 moving toward the toe section. Importantly, the first pivot pin 72 will be located on the foot pad closer to the heel edge 66 than to the toe edge 68. In one embodiment, the first pivot pin 72 is located on the foot pad along the longitudinal axis 70 within two inches of heel edge 66.

Figure 16:
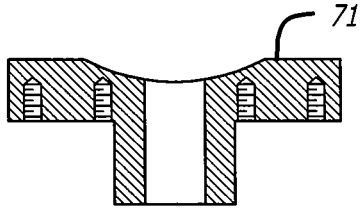
FIG. 16 is a side elevational view of a mounting plate upon which the foot pad is mounted.
Figure 17:
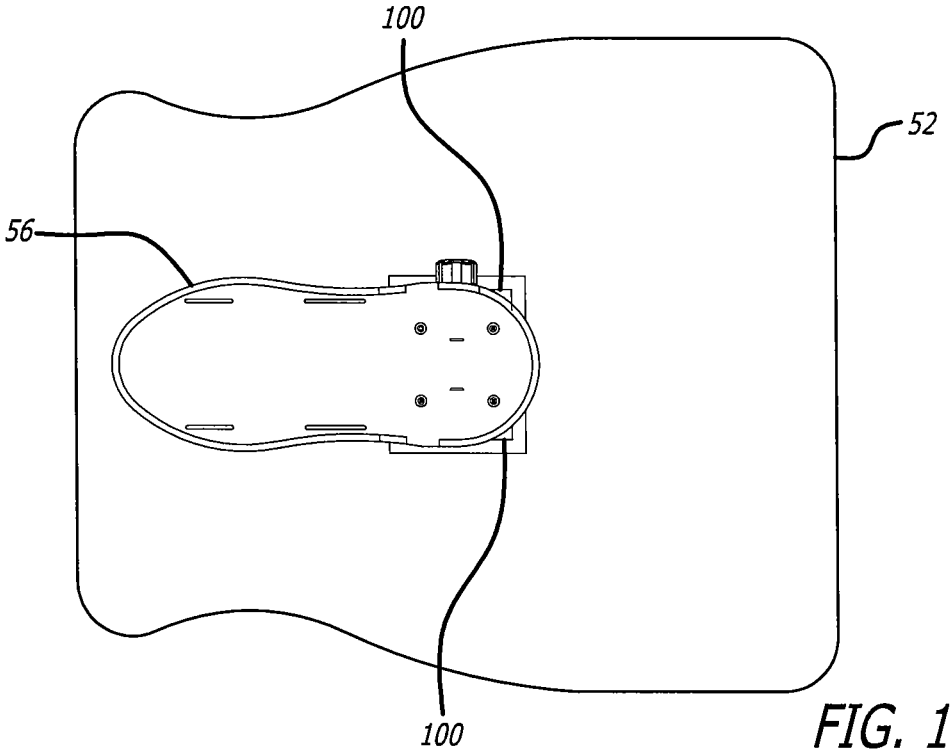
FIG. 17 is a top view of a foot pad mounted on a frame and base on which the foot pad can tilt up to 90° with the toe section higher than the heel section.
Figure 18:
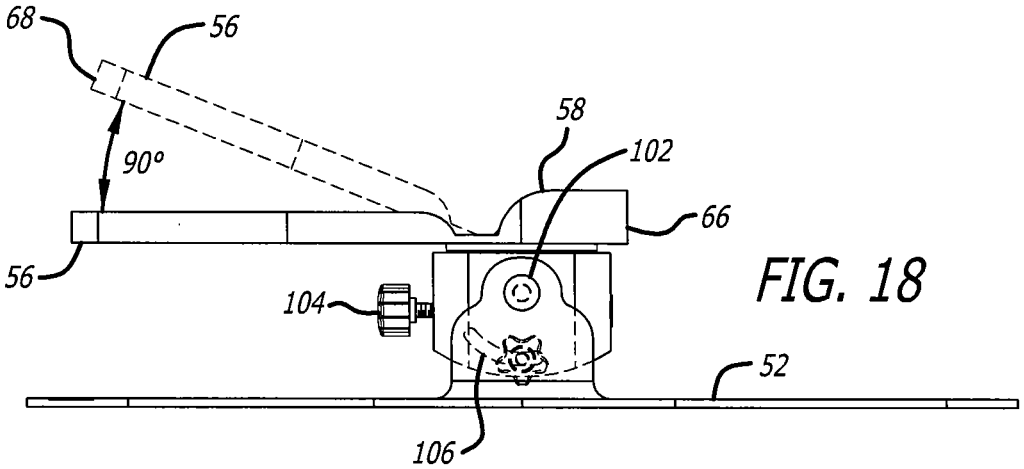
FIG. 18 is a side elevational view of the foot pad mounted on the base and showing the foot pad tilting with the toe section higher than the heel section.
Figure 19:
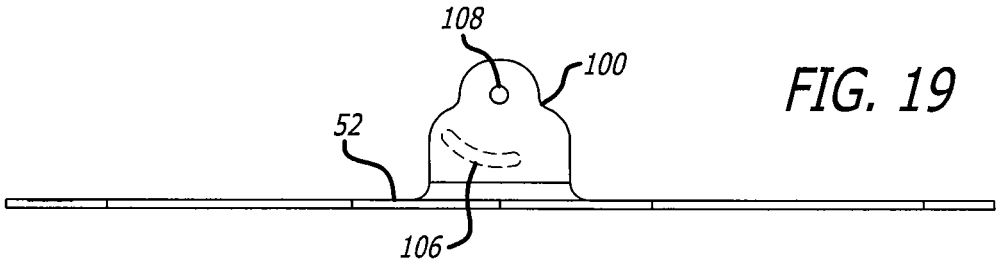
FIG. 19 is a side elevational view of a tilt plate for use in tilting the foot pad through about a 90° arc.

In another embodiment of the invention, as shown in FIGS. 16-18, the foot pad 56 is mounted so that the foot pad can tilt to accommodate someone sitting in a chair. In this embodiment, one or more tilt plates 100 support the foot pad and allow the foot pad to tilt up to 90° by rotating on second pivot pin 102. As can be seen in FIG. 17, for example, the dotted line shows the foot pad elevating from a horizontal toward a vertical position and up to 90° in order to accommodate someone sitting in a chair. The toe edge 68 will be higher than the heel edge 66 when the foot pad 56 is rotated upwardly on pivot pin 102. A locking knob 104 is used to prevent the foot pad from tilting, and when unscrewed, allows the foot pad to tilt upwardly and then knob 104 is turned to lock the foot pad in the tilted angular position. An arcuate slot 106 in the tilt plates 100 allow the foot pad to move along the arcuate path as described. The second pivot pin 102 extends through bore 108 and is positioned near the heel section 58 of the foot pad 56.

While not shown in the drawings, it is contemplated that foot pad 56 can be mounted on the frame so the foot pad can tilt in any direction including with the toe section being above the heel section, or laterally from side to side.

In use, the foot exercise machine 10 as shown in FIGS. 4-18 is used to generally strengthen the foot and in particular to treat plantar fasciitis. A patient places their foot on the foot pad 56 and adjusts the restraint 64 on the foot pad to firmly secure the foot to the foot pad. A suitable amount of resistance is selected so that the patient can do multiple repetitions moving to the right or to the left. The longitudinal axis 70 represents a neutral position where there is no resistance on the foot pad or the patient's foot. As the patient moves his foot to the right, for example, he will encounter resistance as the foot pad pivots at the pivot point located closer to the heel section than the toe section of the heel pad. The patient can move the foot up to 120° to the right and encounter resistance throughout the movement to the right. When the patient completes the movement to the right, he will then move the toe section along the arc line back toward the neutral position. In moving left back to the neutral position, the patient also encounters resistance on the foot. Similarly, the foot pad can be moved to the left through an arc of 120° encountering resistance moving both to the left and back to the right. Again, there is no resistance at the neutral position. The flange 62 on the foot pad helps to secure the patient's foot during the lateral movements to the right and the left during use.

If the patient is unable to stand during the exercise routine, the patient can sit in a chair and the foot pad 56 can be tilted at an angle to accommodate the patient's sitting position. Thus, referring to FIGS. 16-18, the patient, from a seated position, places his foot on foot pad 56 and attaches the restraint 64 as previously described. Using locking knob 104, the locking knob is turned thereby releasing the foot pad so that it can tilt by pivoting on second pivot pin 102 along an arcuate slot 106 in tilt place 100. The foot pad can tilt up to an angle of about 90° to accommodate the seated patient. After tilting the tilt pad 56 so that the toe section 60 is higher than the heel section 58, the locking knob is returned to a closed position thereby locking the foot pad at an angle and so that the patient can then begin the exercise.

The above-described apparatus and use is not limited to a device for use in a gym or health club, but also can be used and modified for use at home. Further, while a weight stack has been described, it is contemplated that other forms of resistance can be substituted for the weights, such as stretchable bands, hydraulic pistons, and the like. Also, references herein to a patient is broadly defined so that anyone seeking to strengthen their foot, whether or not they have plantar fasciitis.

What is claimed:

1. An apparatus for treating the foot, comprising:

a base having a frame attached thereto;

a foot pad having a heel section and a toe section and being pivotally mounted on the frame;

a resistance member associated with the foot pad;

the foot pad being mounted on a first pivot pin and a second pivot pin, the first pivot pin being positioned within 2.0 inches of a heel edge so that the foot pad pivots at the heel section and the toe section moves on an arc line against the resistance of the resistance member, and the second pivot pin being positioned in the heel section to provide pivotal movement so that the toe section can pivot to a position above the heel section;

wherein the foot pad has a neutral position where there is no resistance on the toe section;

wherein the toe section moves along the arc line up to 120° range of motion from the neutral position to the right and to the left; and wherein the resistance member is a coil spring.

2. The apparatus of claim 1, wherein the coil spring provides resistance to the toe section as the toe section moves either to the right or the left along the arc line through the 120° range of motion.

3. The apparatus of claim 2, wherein the coil spring is adjustable in order to increase or decrease resistance on the movement of the toe section.

4. The apparatus of claim 3, wherein an adjustment screw is rotated clockwise or counterclockwise to increase or decrease a length of the coil spring and hence change the resistance of the coil spring.

5. The apparatus of claim 1, wherein the foot pad is mounted on a second pivot pin so that the foot pad can tilt at an angle of up to 90° so that the toe section is higher than the heel section.

6. The apparatus of claim 1, wherein the foot pad has a flange to help retain the patient's foot on the foot pad during use.

7. The apparatus of claim 6, wherein the foot pad has a removable restraint device to temporarily secure the patient's foot to the foot pad during use.

8. The apparatus of claim 1, wherein the resistance member is adjustable so that the resistance on the toe section is equivalent to lifting a weight in the range of one pound up to eighty pounds.

9. An apparatus for treating the foot, comprising:

a base having a frame attached thereto;

a foot pad having a heel section and a toe section and being pivotally mounted on the frame;

a resistance member associated with the foot pad;

the foot pad being mounted on a first pivot pin and a second pivot pin, the first pivot pin being positioned within 2.0 inches of a heel edge so that the foot pad pivots at the heel section and the toe section moves on an arc line against the resistance of the resistance member, and the second pivot pin being positioned in the heel section to provide pivotal movement so that the toe section can pivot to a position above the heel section.

wherein the foot pad has a toe edge and a longitudinal axis extending through the heel edge and the toe edge, the first pivot pin being positioned substantially along the longitudinal axis between 2.0 inches and 4.0 inches from the heel edge; and wherein the foot pad is removably mounted on the pivot pin so that the foot pad can be repositioned along the longitudinal axis to thereby reposition the pivot pin relative to the heel edge.

10. An apparatus for treating the foot, comprising:

a base having a frame attached thereto;

a foot pad having a heel section and a toe section and being pivotally mounted on the frame;

a resistance member associated with the foot pad; and the foot pad being mounted on a first pivot pin positioned in the heel section within 2.0 inches of a heel edge so that the foot pad pivots at the heel section and the toe section moves on an arc line against the resistance of the resistance member;

the foot pad being mounted on a second pivot pin so that the toe section can tilt above the heel section;

wherein the foot pad has a neutral position where there is no resistance on the toe section;

wherein the toe section moves along the arc line up to 120° range of motion from the neutral position to the right and to the left wherein the resistance member is a coil spring; and wherein the resistance member is a coil spring.

11. The apparatus of claim 10, wherein the coil spring provides resistance to the toe section as the toe section moves either to the right or the left along the arc line through the 120° range of motion.

12. The apparatus of claim 11, wherein the coil spring is adjustable in order to increase or decrease resistance on the movement of the toe section.

13. The apparatus of claim 12, wherein an adjustment screw is rotated clockwise and counterclockwise to increase or decrease a length of the coil spring and hence change the resistance of the coil spring.

14. The apparatus of claim 10, wherein the foot pad has a flange to help retain the patient's foot on the foot pad during use.

15. The apparatus of claim 14, wherein the foot pad has a removable restraint device to temporarily secure the patient's foot to the foot pad during use.

16. The apparatus of claim 10, wherein the resistance member is adjustable so that the resistance on the toe section is equivalent to lifting a weight in the range of one pound up to eighty pounds.

17. The apparatus of claim 10, wherein the foot pad has a heel edge and a toe edge and a longitudinal axis extending through the heel edge and the toe edge, the pivot pin being positioned substantially along the longitudinal axis within 4.0 inches from the heel edge.

18. The apparatus of claim 17, wherein the foot pad is removably mounted on the pivot pin so that the foot pad can be repositioned along the longitudinal axis to thereby reposition the pivot pin relative to the heel edge.

19. A method for treating the foot, comprising:

removeably securing a resistance member to the toe area of the foot;

pivoting the foot on a first pivot point positioned within 2.0 inches of a heel edge;

from a neutral position, moving the toe area along an arc line against a force generated by the resistance member as the foot pivots on the first pivot point;

moving the toe area back along the arc line as the foot pivots on the first pivot point and returns to the neutral position; and moving the toe area above a heel section against resistance by pivoting the heel section on a second pivot point positioned in the heel section.

* * * * *